US011070907B2

(12) United States Patent
Taenzer

(10) Patent No.: US 11,070,907 B2
(45) Date of Patent: Jul. 20, 2021

(54) SIGNAL MATCHING METHOD AND DEVICE

(71) Applicant: Khaled Shami

(72) Inventor: Jon C. Taenzer, Los Altos, CA (US)

( * ) Notice: Subject to any disclaimer, the term of this patent is extended or adjusted under 35 U.S.C. 154(b) by 167 days.

(21) Appl. No.: 16/394,828

(22) Filed: Apr. 25, 2019

(65) Prior Publication Data

US 2020/0344543 A1 Oct. 29, 2020

(51) Int. Cl.

| | |
|---|---|
| ***H04R 1/40*** | (2006.01) |
| ***H04R 29/00*** | (2006.01) |
| ***H04R 1/26*** | (2006.01) |
| ***H04R 1/34*** | (2006.01) |

(52) U.S. Cl.

CPC ..... *H04R 1/26* (2013.01); *H04R 1/342* (2013.01)

(58) Field of Classification Search

CPC .... H04R 29/006; H04R 1/406; H04R 29/004; H04R 29/005

See application file for complete search history.

(56) References Cited

U.S. PATENT DOCUMENTS

| | | | | |
|---|---|---|---|---|
| 6,272,229 | B1 | 8/2001 | Baekgaard | |
| 6,549,627 | B1 | 4/2003 | Rasmusson et al. | |
| 6,741,714 | B2 | 5/2004 | Jensen | |
| 7,027,607 | B2 | 4/2006 | Pedersen et al. | |
| 7,155,019 | B2 | 12/2006 | Hou | |
| 7,203,323 | B2 | 4/2007 | Tashev | |
| 7,274,794 | B1 * | 9/2007 | Rasmussen | H04R 3/005 381/92 |
| 7,472,041 | B2 | 12/2008 | Taenzer et al. | |
| 7,688,985 | B2 | 3/2010 | Roeck | |
| 8,155,926 | B2 | 4/2012 | Taenzer et al. | |
| 8,620,672 | B2 * | 12/2013 | Visser | H04R 3/005 704/500 |
| 2004/0228495 | A1 | 11/2004 | Amdt et al. | |
| 2005/0244018 | A1 | 11/2005 | Fischer et al. | |
| 2005/0249359 | A1 | 11/2005 | Roeck | |
| 2006/0013412 | A1 | 1/2006 | Goldin | |
| 2006/0222184 | A1 | 10/2006 | Buck et al. | |
| 2007/0009121 | A1 | 1/2007 | Petersen | |
| 2007/0055505 | A1 | 3/2007 | Doclo et al. | |
| 2007/0086602 | A1 | 4/2007 | Petersen et al. | |

OTHER PUBLICATIONS

Chung, King, "Challenges and Recent Developments in Hearing Aids", Trends in Amplification, vol. 8, No. 3, 2004. 42 Pages.

(Continued)

*Primary Examiner* — Kile O Blair
(74) *Attorney, Agent, or Firm* — Shami Messinger PLLC

(57) ABSTRACT

In one embodiment, a method for matching sensors includes generating a first and second sensor signals respectively from first and second sensors, separating the sensor signals into magnitude and phase components, determining a phase difference from the phase components, and matching the magnitude of the first sensor signal to that of the second sensor signal by multiplying the magnitude of the first sensor signal by a magnitude correction value that is a function of a ratio of the phase components of the first and second sensor signals.

20 Claims, 9 Drawing Sheets

(56) References Cited

OTHER PUBLICATIONS

Doclo et al., "Design of a robust multi-microphone noise reduction algorithm for hearing instruments", Proc. of the International Symposium onMathematical Theory of Networks and Systems (MTNS2004), Leuven, Belgium, Jul. 5-9, 2004. 10 pages.
Doclo et al., "Design of broadband beamformers robust against gain and phase errors in the microphone array characteristics", IEEE Transactions on Signal Processing, vol. 51, No. 10, pp. 2511-2526, Oct. 2003. 35 pages.
Dynamic Hearing, "Adaptive Directional Microphone Module for Gennum PLA Tforms", Dynamic Hearing Product Brochure, N.D., 5 Pages.
Elko, Gary, "A Simple Adaptive First-Order Differential Microphone", White Paper, Bell Labs, Lucent Technologies, N.D., 10 Pages.
Gennum Corporation, "Calibrating the FRONTWAVE Directional System", Product Manual, N.D., 3 Pages.
Gennum Corporation, "Obtaining Directionality Using FRONTWAVE Multi-Microphone Hybrid", Product Manual, N.D., 4 Pages.
Nordholm, et al., "Adaptive Microphone Array Employing Calibration Signals: An Analytical Evaluation", IEEE Transactions on Speech and Audio Processing, vol. 7, No. 3, May 1999. 12 Pages.
Powers, Thomas et al., "Wireless technology designed to provide true binaural amplification" The Hearing Journal, Jan. 2005 •vol. 58 •No. 1. 5 Pages.
Requirement for Restriction/Election, U.S. Appl. No. 16/295,451 entered Jun. 7, 2019. 5 Pages.
Taschev, Ivan, "Beamformer Sensitivity to Microphone Manufacturing Tolerances" White Paper, Microsoft, Inc. N.D., 5 pages.
Taschev, Ivan, "Gain Self-Calibration Procedure for Microphone Arrays" White Paper, Microsoft, Inc. N.D., 4 pages.
Thompson, Stephen C.,"Electrical Compensation of the microphone sensitivities in a dual microphone directional hearing aid", Knowles Electronics, N.D., 8 pages.
Warren, Daniel.,"Microphone Matching for hybrid-order directional arrays in hearing aid applications", Knowles Electronics, N.D., 31 pages.
Sachar et al., "Microphone Position and Gain Calibration for a Large-Aperture Microphone Array", IEEE Transactions on Signal Processing, vol. 13, No. 1, pp. 42-52, Jan. 2005. 11 pages.

* cited by examiner

Classical First-Order Delay-and-Add Beamformer

First-order Difference Beam Pattern

Acoustic Geometry of a First-Order Pressure Microphone Array System

Cardioid Beam Patterns vs Mic Mismatch for a 2-Element Array with 1-cm Mic Spacing
Left to right: perfect matching, ±1 dB mismatch, ±2 dB mismatch, ±3 dB mismatch Cardioid Frequency Response vs Mic Mismatch for a 2-Element Array with 1-cm Mic Spacing Frequency Domain Signal Processing Implementation Method Signal Flow Diagram Examples of Proportional Averaging

SIGNAL MATCHING METHOD AND DEVICE

TECHNICAL FIELD

The present disclosure relates generally to signal matching in sensor systems.

BACKGROUND

Directional microphone (mic) systems utilizing arrays of microphone elements are well known. However, there are limitations to the amount of directionality achievable with such systems due to the inevitable mismatch between the elements. As is known, the problem can be, at least partially, mitigated by using pre-matched elements or by some type of calibration. However, these solutions can achieve only limited matching, and are expensive and difficult to achieve in manufacturing situations. Thus, systems where computational means are used to create and apply a correction to the microphone signals in order to make their signals match have been developed. Using numerous different matching methods, these systems are either "fixed" or operate in "real time", i.e. are adaptive.

Although many types of microphone elements are available, for practical reasons, mobile equipment developers have used electret-based units (known as ECMs) but are moving to silicon Micro-Electro-Mechanical Systems, or MEMS, microphone elements for their numerous cost and implementation advantages. Concurrently, to achieve improved noise immunity, microphone array beamformer systems of two or more elements have become common, particularly in headsets, mobile phones and tablets.

First-order acoustic beamformers can be constructed using a single, dual-ported, first-order [pressure gradient] microphone element. Because the same element receives sound from multiple sound inlet ports, the microphone sensitivity is identical for all sound signals entering the "array", and microphone matching is inherent in the design. However, when using single-ported, zeroth-order (i.e. pressure) elements, electronic array beamforming methods must be applied, and in this case the microphone element signals may not be well matched due to normal manufacturing sensitivity and frequency response tolerances, i.e. dissimilarities between the microphone elements used in the array. For good performance, it is essential that the separate microphone signals be well matched, or the resultant sensory beam significantly degrades. As an example, MEMS microphone elements, although being very attractive for production reasons, are not available in pressure gradient versions, so for use in microphone arrays, MEMS microphones must be separately matched in sensitivity and frequency response.

Numerous microphone matching schemes have been developed in the past, ranging from pre-production testing and binning of elements, to complex adaptive signal matching algorithms operating in real-time. Product designs based on pre-production microphone selection and postproduction calibration methods suffer from degradation due to temperature/humidity variations and microphone element aging over time. Adaptive methods overcome these drawbacks, and therefore are often the method of choice. Examples of prior art adaptive methods include i) simple matching of the average signal levels between the input signal channels and their respective microphone elements, ii) controlling signal matching filter characteristics based upon microphone signal magnitude comparisons or user's own voice and iii) matching of the microphone responses, but only at low frequencies below 500 Hz. These are only examples of prior art microphone matching schemes. There are many others, but none known where the phase difference between the microphone signals is used to create a magnitude matching table in the manner described herein.

It is known that beamformers are more sensitive to variations in the magnitude, as opposed to the phase, of the elements' response. Higher order microphone array beamformer systems are even more sensitive to element mismatches, and their performance degrades very rapidly with even small mismatches. Most discussions of microphone array systems assume perfectly matched elements, and they ignore the performance degradation that occurs when the elements are not matched. Although microphone matching is required, often this is not addressed. Further, it is necessary for any adaptive microphone matching method to be accurate, rapid, robust, easy to implement, low cost and consume little computational resources.

FIG. 1 shows a standard prior art first-order beam forming system using two zeroth-order sound pressure elements, 32 and 34. FIG. 2 shows the omni-directional sensitivity pattern of a single zeroth-order microphone element as used in such an array beamformer. In this beamformer, sound coming from the 0° direction along the X-axis is the desired sound to be received, thus microphone 32, creating signal A, is called the front microphone, while microphone 34, creating signal B, is called the rear microphone. Depending upon the spacing, sp, and speed of sound between the two elements, an external time delay, dsp, exists between the two signals for sounds arriving from the 0° direction. By subtracting from the front signal A, at adder 38, a delayed version of the rear signal B generated by the internal time delay, 37, an output signal from the beamformer, 39, with first-order directional sensitivity is created as seen in FIG. 2.

Choosing various values of time delay for block 37 allows for the creation of any of the well-known first-order patterns. Of particular interest is the figure-8 pattern depicted in FIG. 2, in which the internal time delay 37 is set at zero (i.e., absent). The figure-8 patterns is also known as the dipole, or the Noise Cancelling (NC) pattern.

The sensitivity beam so formed consists of a front lobe, 35, and a rear lobe, 36, which are equal. When an acoustic sound signal arrives from the side of the array, i.e. from along the Y-axis, the sound pressure is identical at both microphones so that in a perfectly matched system, after the signal subtraction, the microphone signals cancel giving rise to the "null" in the beam pattern. If the microphones have different sensitivities, then the signals will not cancel and the pattern null will "fill in" producing a pattern that is more nearly omni-directional.

Pattern shape is set by several variables, besides the delay. FIG. 3 shows the acoustic geometry of a first-order array system, 40. Here a front signal microphone, A, and a rear signal microphone, B, are shown spaced apart by a distance, sp, along the X-axis. A source of sound, S, is located a distance, D, away from the array and at an angle $\phi s$ relative to the X-axis. Sound from the source arrives at the two microphones along two different paths and is converted by the microphones to a pair of electrical signals, A and B, each with its own a magnitude and a phase. Assuming that distances are measured in terms of wavelength, then the determinants of the beam shape are the spacing, sp, source distance, D, arrival angle $\phi s$, and the internal time delay of block 37.

When the internal time delay is set to equal the external delay, dsp, another beam shape of interest, the cardioid pattern, shown in FIG. 4, is created. This pattern has virtually all of its sensitivity directed toward the front of the array. FIG. 4 also shows the effect of microphone sensitivity mismatch on the cardioid pattern of a pair of zeroth-order microphone elements spaced 1-cm apart and for microphone sensitivity differences of 0 db (ideal), ±1 dB, ±2 dB and ±3 dB. The patterns at six different frequencies are shown in each graph.

Typical MEMS microphone elements come from the factory with a sensitivity tolerance specification of ±3 dB corresponding to the right-hand set of beam pattern curves in FIG. 4. Newer devices can be purchased with a tolerance of ±2 dB corresponding to the third set of beam pattern curves. Notice that even a ±1 dB mic sensitivity difference, corresponding to the second set of beam pattern curves, produces a significant degradation in the beam patterns. Compared to the ideal patterns shown in the left-hand set of beam pattern curves, the directionality becomes almost omni-directional, especially at lower frequencies where environmental noise energy is highest and greatest directionality is therefore most needed. This loss of directionality with mismatch makes good microphone matching essential for achieving the desired performance in mic array systems.

Microphone mismatch also changes the frequency response of an array system. FIG. 5 shows the effect of microphone mismatch on the frequency response of a first-order cardioid microphone array system's output signal. Clearly, the frequency response dramatically changes when the element signals are mismatched by even a small amount, with a significant response increase for bass sounds and a cut in high frequency response. Sounds, therefore, become "muddy" and speech becomes difficult to understand and lacks intelligibility with mismatched elements.

FIG. 6 depicts a known frequency domain conversion method and corresponds to FIG. 1 of U.S. Pat. No. 8,155,926, whose contents are incorporated herein by reference in their entirety. Briefly, system 10 employs what may be referred to as the frequency sub-band method or the frame-overlap-and-add method. A circuit 12 divides incoming sampled temporal signal information into blocks of data referred to as frames. The frames can be adjacent or overlapping. Since the data are samples of time domain data, all samples within a frame have no imaginary component, and the data is strictly "real." The frames of data then may be multiplied in a multiplication circuit 13 by an analysis window 14 to reduce artifacts. Subsequently, the windowed frames are transformed to the frequency domain using for example a fast Fourier transformation at 16. Once in the frequency domain, the data is represented by complex numbers containing both a "real" and an "imaginary" component. These complex numbers, one for each frequency "bin" of the transform, represent the magnitude and relative phase angle of the temporal input signal data averaged over the time interval contained within the length of the frame (and weighted by the windowing function) as well as over the range of frequencies contained within the bandwidth of the bin. It is this input transform data that is then processed at circuit 17 by a selected process to create an output transform of processed frequency domain data.

Once the data is processed, the standard frequency domain method then calls for inverse transformation of each frame of processed data to create a string of processed time domain frames of "real" data. Circuit 18, denoting an inverse fast Fourier transform (IFFT) process, performs this objective. The output frame of data from circuit 18 may then be passed to circuit 19. The time domain frames are subsequently re-assembled by circuit 19 by performing concatenating or overlapping-and-adding of the frames of processed real-time data to create the final digitized and sampled temporal output signal waveform containing the processed signal information.

FIG. 7 depicts a process for separation of each frame of the microphone signal data into magnitude and phase information and corresponds to FIG. 5 of U.S. Pat. No. 8,155,926. Alternatively, any method for implementing this separation can be used. Using the phase information in corresponding frames of the two microphone signals, the phase difference between the microphone signals is calculated, as shown in FIG. 7 at 52 and detailed in the U.S. Pat. No. 8,155,926. Also, alternatively, time-domain means can be used, e.g. by applying Hilbert transformer methods.

In U.S. Pat. No. 7,472,041, the parent of U.S. Pat. No. 8,155,926 and also incorporated herein by reference in its entirety, a microphone matching method is applied to the signal pairs between the microphone outputs and the beam former input wherein the individual microphone signal magnitudes are replaced with a mean of the magnitudes making the pairs of magnitudes the same. This method of signal matching was developed for use in a far-field, broadside microphone array system, but may not be ideal for use in a near-field, end-fire array because the small differences in the signal magnitudes, crucial for creating the desired near-field sensitivity pattern, are destroyed by this matching method.

Overview

Described herein is an approach for achieving directionality using non-selected, off-the-shelf elements in microphone arrays, while achieving excellent array directionality, esp. with the use of MEMS microphone elements which are only available as omni-directional devices. In real-life communications applications, this creates a higher voice-to-background-noise ratio in an array's output signal, achieving higher intelligibility of the voice signal. Thus one application is for array systems in general. Some advantages include a faster, more reliable and accurate microphone match than formerly available, easy implementation, high compatibility with other sound processing methods (specifically with noise reduction algorithms and processing) and optimized signal-to-noise and directionality performance. The described approach of microphone matching, e.g. when used in beamforming applications, can provide optimized signals to the user for increasing the understanding of speech in noisy environments as compared to current technology. Other applications for the matching described herein are for products other than voice communication, such as hearing aids, voice-recognition headsets, computer microphones (e.g. those embedded in the face of monitors), conference call and speaker phones, and anywhere that an array sound pickup is desired. Also, the approach is adaptable to other non-mic sensory systems, such as antenna, sonar, medical ultrasound arrays, and so on. The technology described herein fits extremely well with current technologies and specifically DSP software algorithms.

Referring to the first-order beam forming system using two zeroth-order sound pressure elements as an example, since it is known that the two microphone signals should be identical in both amplitude and phase, the phase difference between the two microphone signals must be zero, and that difference value can be used to trigger the creation of a magnitude matching correction. Therefore, by monitoring the phase difference, whenever it is zero, or very close to zero, a table of mismatch correction values can be updated by averaging in the current value of amplitude, magnitude or level ratio or difference.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Figure 1:
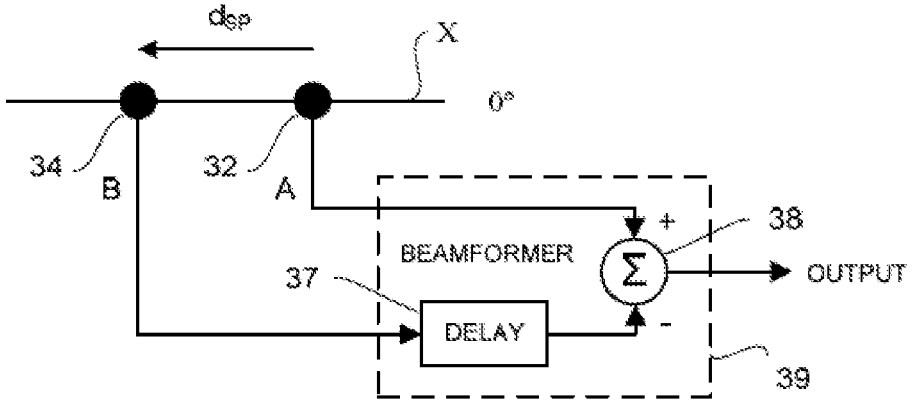
FIG. 1 (Prior Art)
FIG. 1 is a prior art first-order beam forming system using two zeroth-order sound pressure elements.
Figure 2:
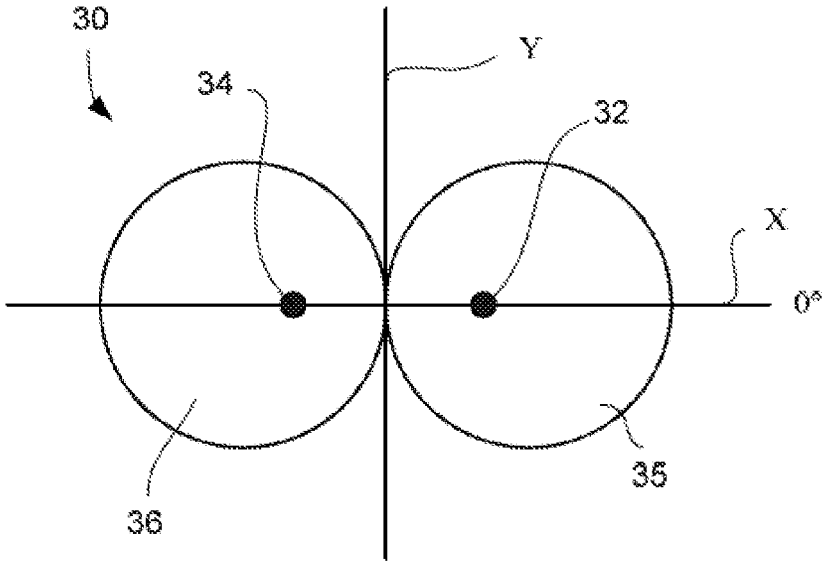
FIG. 2 (Prior Art)
FIG. 2 is an omni-directional sensitivity pattern of a single zeroth-order microphone element.
Figure 3:
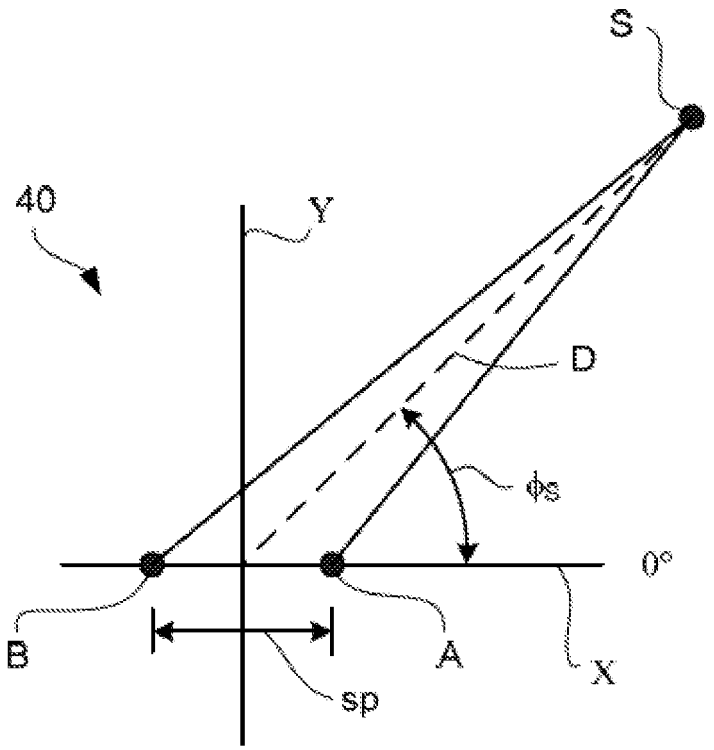
FIG. 3 (Prior Art)
FIG. 3 shows the acoustic geometry of a prior art first-order array system.
Figure 4:
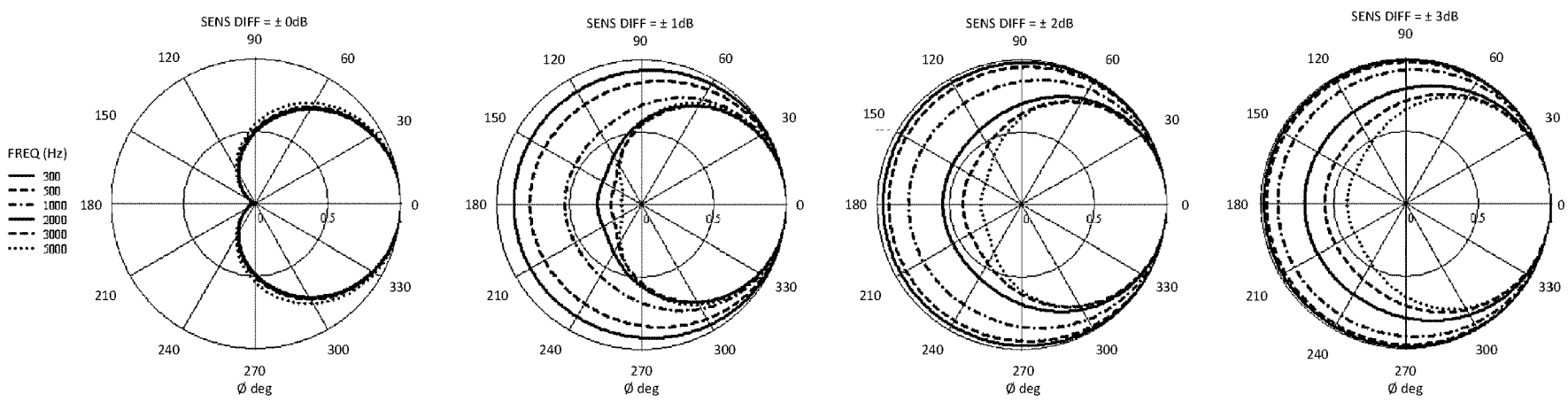
FIG. 4 (Prior Art)
FIG. 4 shows plots of cardioid beam patters vs. microphone mismatch.
Figure 5:
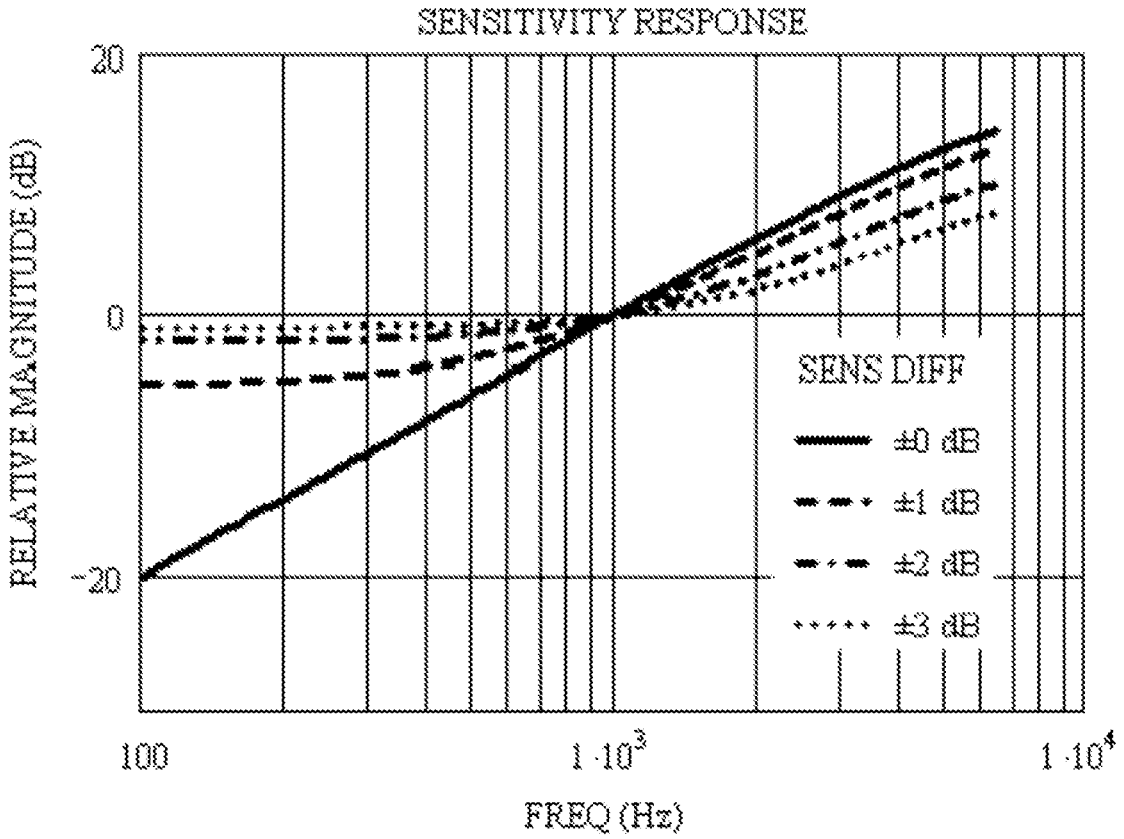
FIG. 5 (Prior Art)
FIG. 5 shows plots of cardioid frequency response vs. microphone mismatch for a 2-element array with 1-cm microphone spacing.
Figure 6:
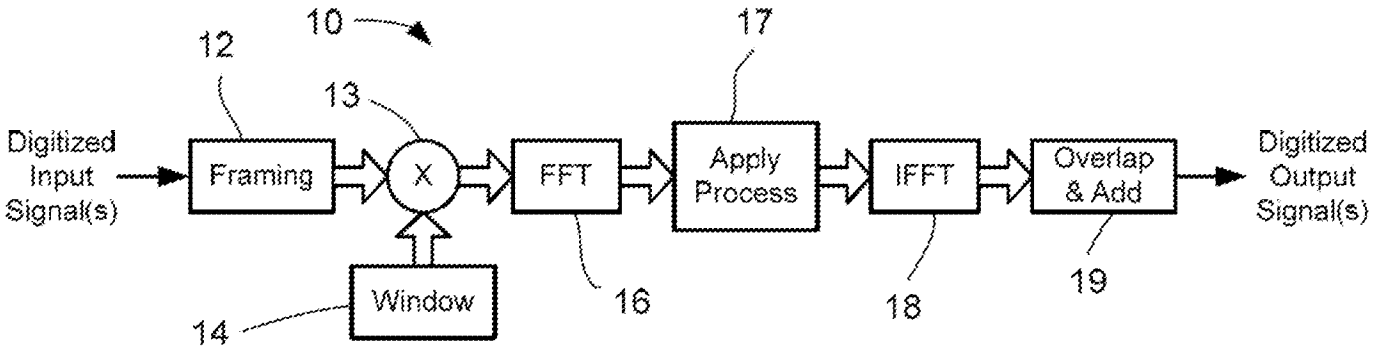
FIG. 6 (Prior Art)
FIG. 6 is a block diagram illustrating a known frequency domain conversion process.
Figure 7:
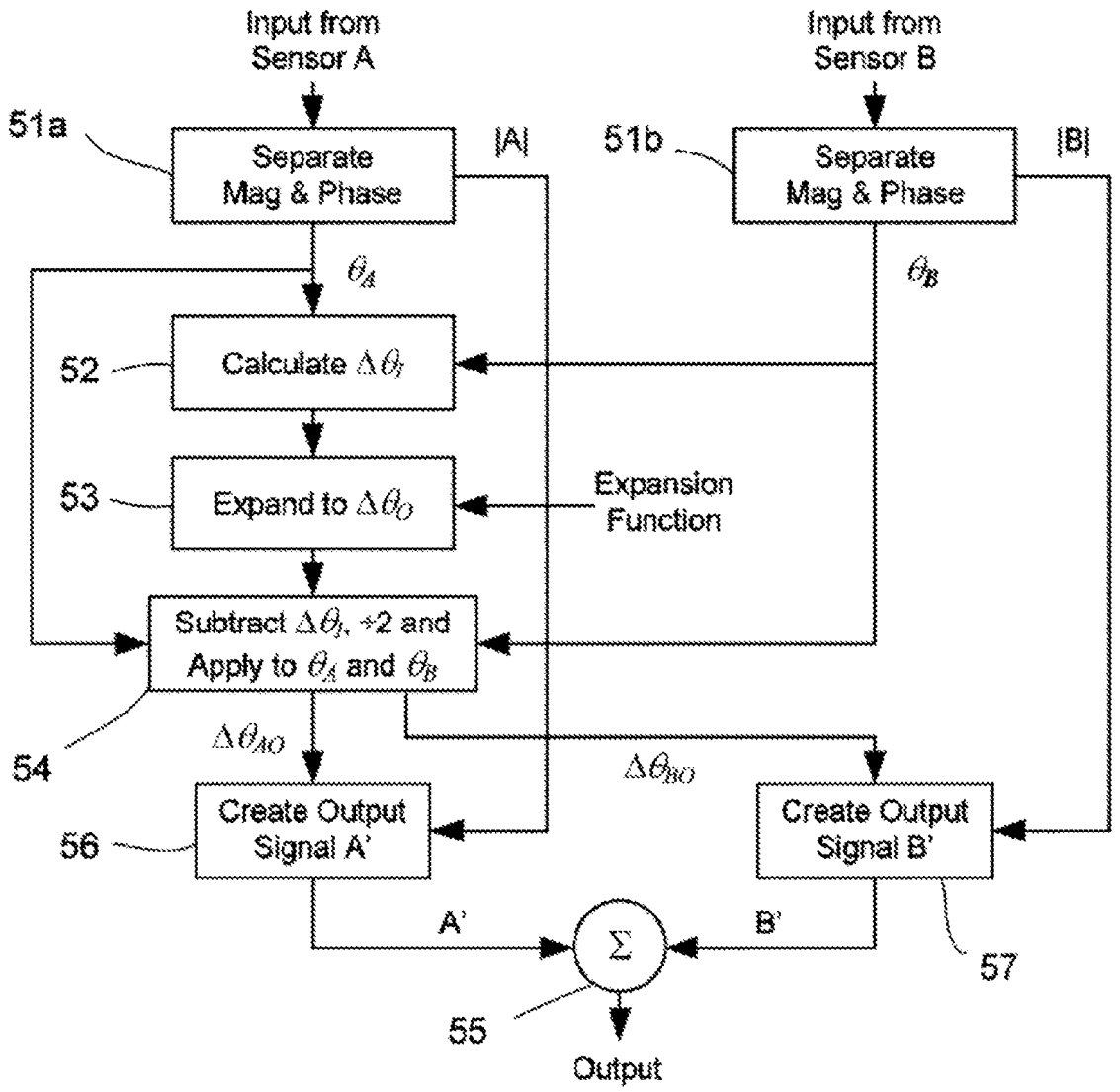
FIG. 7 (Prior Art)
FIG. 7 is a flow diagram of a process for separation of each frame of the microphone signal data into magnitude and phase information

Example embodiments are described herein in the context of a signal matching method and device. The following description is illustrative only and is not intended to be in any way limiting. Other embodiments will readily suggest themselves to those of ordinary skill in the art having the benefit of this disclosure. Reference will be made in detail to implementations of the example embodiments as illustrated in the accompanying drawings. The same reference indicators will be used to the extent possible throughout the drawings and the following description to refer to the same or like items.

In the description of example embodiments that follows, references to "one embodiment", "an embodiment", "an example embodiment", "certain embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. The term "exemplary" when used herein means "serving as an example, instance or illustration." Any embodiment described herein as "exemplary" is not necessarily to be construed as preferred or advantageous over other embodiments.

In the interest of clarity, not all of the routine features of the implementations described herein are shown and described. It will be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with this disclosure, components, process steps, and/or data structures described herein may be implemented using various types of operating systems, computing platforms, computer programs, and/or general purpose machines. Devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Eraseable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card, paper tape and the like) and other types of program memory.

Herein, reference to a computer-readable or machine-readable storage medium encompasses one or more non-transitory, tangible storage media possessing structure. As an example and not by way of limitation, a computer-readable storage medium may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. Herein, reference to a computer-readable storage medium excludes any medium that is not eligible for patent protection under 35 U.S.C. § 101. Herein, reference to a computer-readable storage medium excludes transitory forms of signal transmission (such as a propagating electrical or electromagnetic signal per se) to the extent that they are not eligible for patent protection under 35 U.S.C. § 101. A computer-readable non-transitory storage medium may be volatile, nonvolatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Figure 8:
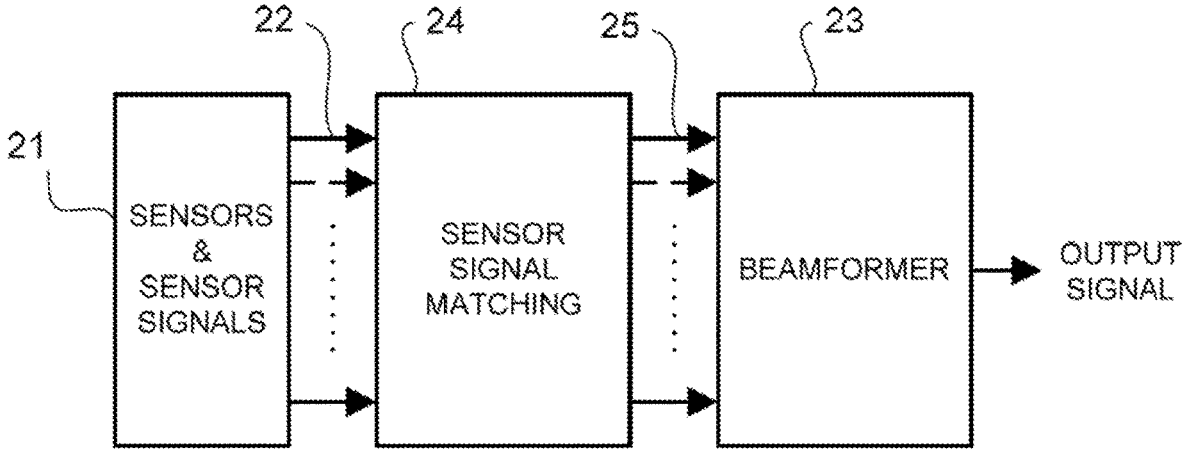
FIG. 8 is a block diagram of a system in which sensor signal matching is performed using preserved near-field cues in accordance with certain embodiments.

FIG. 8 is a block diagram of a system 20 in which sensor (e.g. microphone) signal matching is performed using preserved near-field cues in accordance with certain embodiments. Generally, in system 20, a sensor matching module or process 24 in accordance with certain embodiments is interposed between sensors and sensor signals 21 and a beamformer process or module 24.

Figure 9:
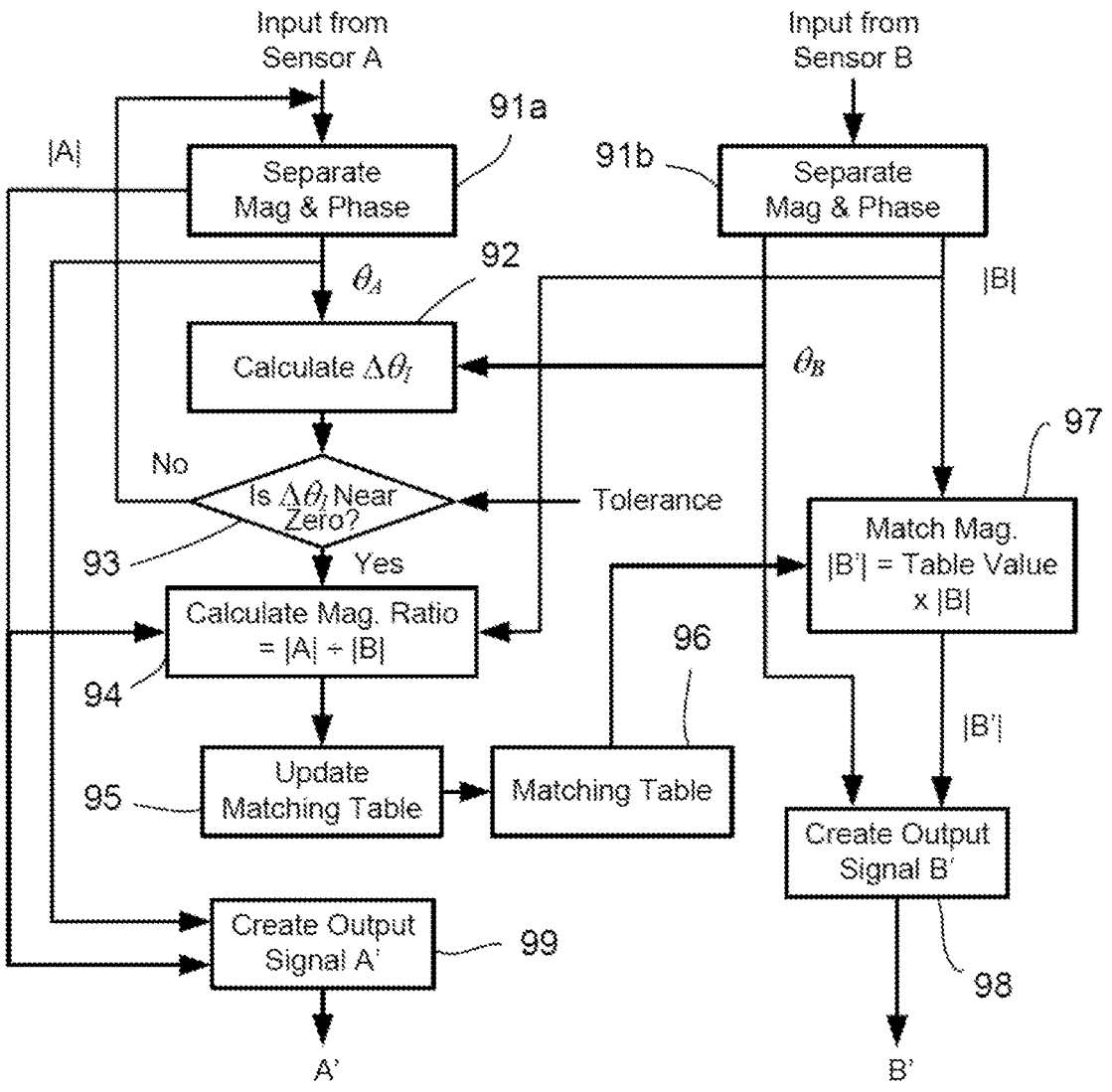
FIG. 9 is a flow diagram of a microphone matching method in accordance with certain embodiments.

FIG. 9 is a flow diagram of a microphone matching method in accordance with certain embodiments. The process is repeated for each frame of data and for each bin, band or sub-band. After the magnitude and phase of each signal are separated, at 91, and the phase difference, $\theta_A-\theta_B$, is calculated, at 92, a decision whether the phase difference is approximately zero (or a predetermined value other than zero) is made, at 93, using a prescribed tolerance value to specify whether the actual phase difference is close enough (to zero or the other predetermined value). In certain embodiments, when any phase difference is within the specified ±tolerance of the threshold, then a magnitude correction value (or matching value) in the matching table, 96, is updated, at 95, for example by averaging the new calculated magnitude correction value, 94, with the previous table value. Details of such updating are discussed further below. The magnitude correction value is a function of the ratio of the magnitudes—that is |A|/|B|—and may be the ratio itself. This updating creates a new, updated magnitude correction value in the table 96. As each frame is processed, the table values are used to match the magnitude of signal B, i.e. |B|, to that of signal A, i.e. |A|, by multiplying |B| with the corresponding correction value in the matching table, at 97. This corrected matched magnitude, |B'|, is then combined with the original phase, $\theta_B$, to create the matched signal B output signal, B'. For signal A, the matched output signal is created by combining the original magnitude values, |A| with the original phase values, $\theta_A$, to generate, at 99, the matched output signal, A'. The two matched output signals, A' and B', are then sent to the beam former. Of course, it is also possible to match the magnitude of signal A to that of signal B in a converse manner.

Note that the process using the matched output signals, A' and B', need not be a beam former, but can be any process requiring a matched set of microphone signals. One example would be a noise reduction process, although there are many others.

In addition, there are myriad ways to create the phase difference at 92, and all these are also contemplated. Further, the actual phase difference need not be determined, but rather the tangent or sine of the difference can be used, for example, since for small angles around zero, these trigonometric functions produce essentially the same result as does the difference. Using a trigonometric function can be easier to compute and consume less compute power. The aforementioned U.S. Pat. No. 8,155,926 discloses how to generate the tangent of the phase difference, for example.

For deciding whether to update a particular matching correction value (matching value), a tolerance can be specified, for example, as a number of degrees, e.g. say 5°. Smaller tolerance values will slow the table update rate and acquisition time, but, in the long run, produce a more accurate matching condition for the signals. Conversely, larger tolerance values will speed up the update rate and shorten the acquisition time for the table values, but with the penalty that the table values will be somewhat less accurate and will be "noisier", i.e. will have more fluctuation over time. This tolerance, or threshold, may be set by the user or by the system.

Figure 10:
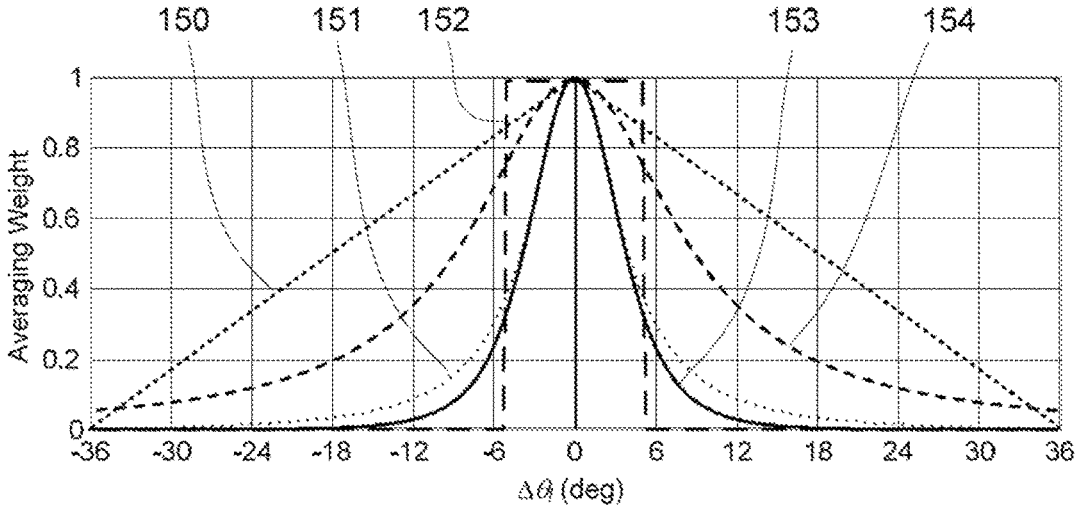
FIG. 10 shows several examples of functions that can be used to weight samples with phase difference.

The prescribed tolerance value is used at 93 so that whenever the phase difference is within ±tolerance of zero, a table update occurs for each bin, band or sub-band that satisfies this tolerance criterion. One alternative (although consuming more compute power) is to use weighted averaging, where the weight is a function of the phase difference, i.e. to average in a proportion of the current magnitude ratio, where the proportion is based on the phase difference. FIG. 10 shows several examples of functions that can be used to weight the samples with phase difference. Curve 152 shows the discrete means described supra where an example tolerance of ±5° tolerance is used. Note that 100% of the current magnitude ratio is averaged into the table whenever the phase difference is within the tolerance band, and 0% is averaged in otherwise in that example. By comparison, curve 150 demonstrates a simple triangular tolerance taper where the magnitude ratio is weighted proportional to the magnitude of the phase difference as it is averaged into the table. With weighting, the further the phase difference is away from zero, the smaller the effect that the current magnitude disparity will have on the table's value. Note that the two points where the "triangle" drops to zero can be moved closer to or further from the center of the graph to make the tolerance band narrower or wider. Curve 153 demonstrates a Gaussian, or normal, weighting, while curve 154 demonstrates a circular normal, or von Mises weighting, which, in a sense, is particularly appropriate since phase difference is circular. An intermediate curve, 151, is another potential choice. Notably, weighted averaging can smooth out relatively rapid variations which would otherwise occur with the discrete tolerance method of the first example when the phase difference is close to the edge of the tolerance band and which can produce artifacts in the beam former output signal.

Tapering the tolerance values as a function of frequency also can be very useful, since the phase difference is a function of wavelength for fixed spaced sensor elements. Thus, for any single angle of signal arrival, the phase difference increases linearly with frequency, and a linearly increasing tolerance can compensate for that characteristic to produce a constant angular tolerance for creating the matching table. Of course, the frequency taper need not be linear, but can take any form the designer requires to produce a particular beneficial signal matching.

Similar to tapering the tolerance with frequency, an alternative is to use Time Difference of Arrival (TDOA) as a substitute for the phase difference. When the TDOA is within "tolerance" of zero, then the table should be updated, as described above. In this case, the need for any linear taper of the tolerance with frequency is avoided. Of course, other tapers can still be used for selected beneficial purposes.

Updates to the matching table 96 can be averaged into the previous table values in many ways, i.e. using: numerical averaging, lowpass filtering, Kalman filtering, boxcar averaging, RMS etc. All methods desirably smooth the updates over time and all ways are contemplated. Kalman filtering has the benefit of quickly producing a good estimate of the average value while achieving very good smoothing. Additional means for smoothing the table values can use adaptive filtering to make the table values "home in" on the best values, ones that create the best match over time. Thus, the process represented by blocks 95 and 96 can be accomplished in many ways to meet the requirements of the system.

Figure 11:
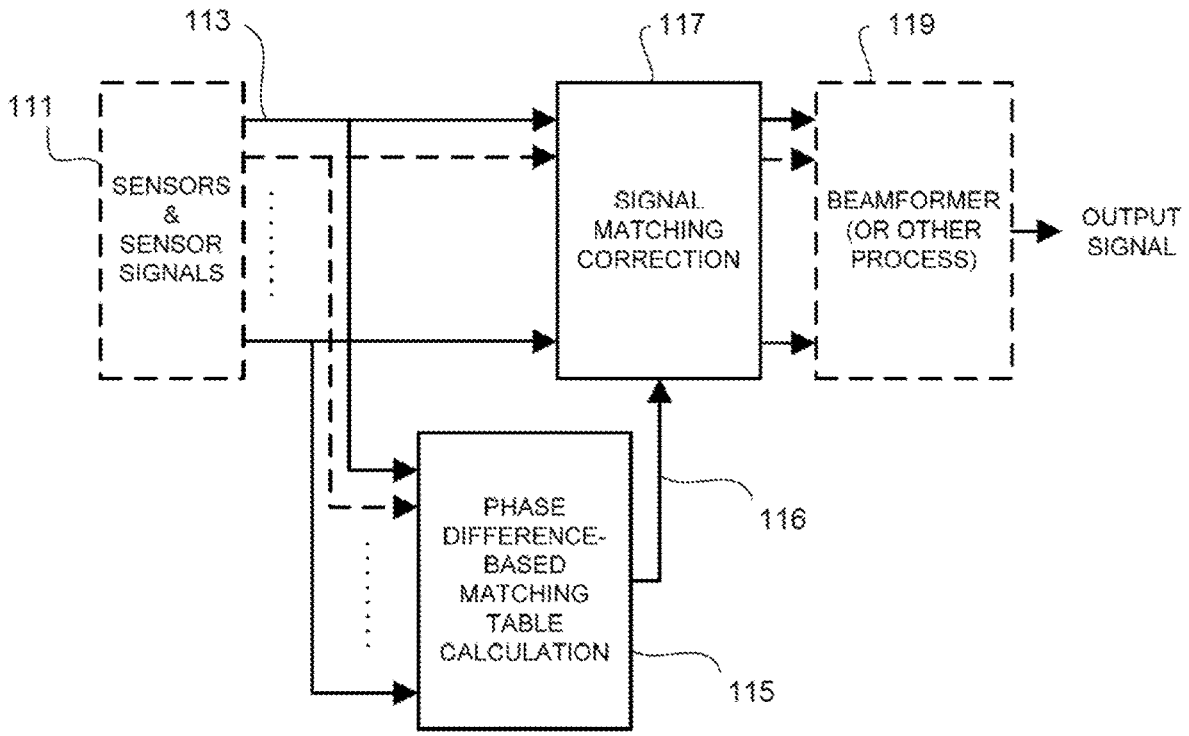
FIG. 11 is a block diagram of a system for signal matching.

In general, a system using the above matching procedure shown in FIG. 11. It should be noted that the signal processing 119 performed after the signal matching described herein need not be just a beam forming process but may be any process whose function is enhanced by having matched input signals. Further, matching table signal 116 may be a single correction signal, if used in a single band implementation, or may be a set of correction signals, one for each sub-band in a multiple sub-band implementation. Additionally, the signal matching need not be limited to microphone signals, but can be applied to many different kinds of sensor signals, such as those from RF antenna array elements, etc. In addition, the the matching scheme is applicable for use in systems with multiple sensors and sensor signals, not just in systems limited to pairs of signals.

The above description has described the application of this sensor matching means to systems when it is known a priori that pairs of signals should have equal magnitudes when the phase difference between the signals is zero, but this is not by way of limitation. Rather, the sensor matching process can easily be adapted to operate in systems where it is known that the equal magnitude should occur at another phase difference value, for example, β. To reflect this generalization, comparison block 93 in FIG. 9 changes to read "Is $\Delta\theta_I$ Near β?" and FIG. 10 would be centered on the phase difference, β. Of course, different β's also can be used for each frequency, depending on the application.

Figure 12:
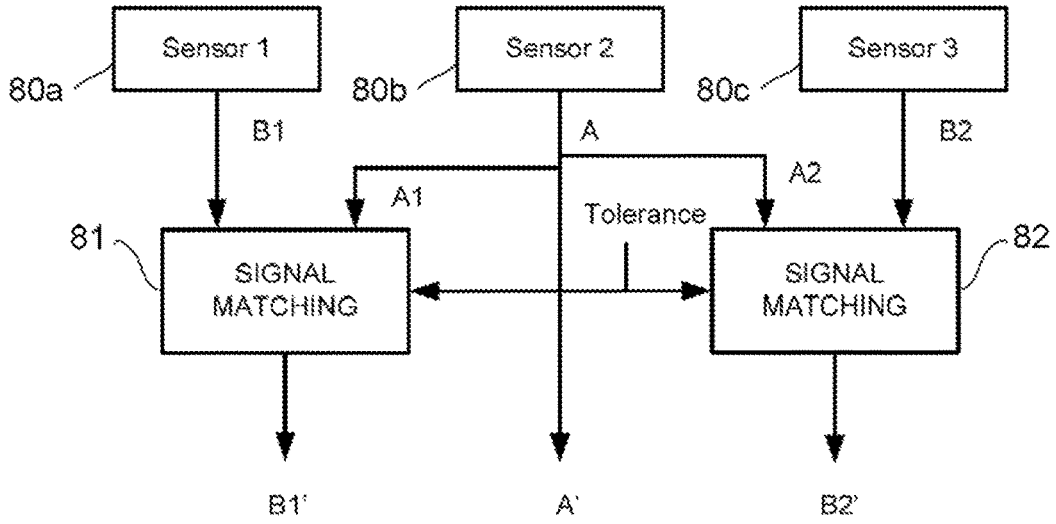
FIG. 12 shows one approach for matching signals from more than two sensors.

It should be understood that the matching process can be extended to a greater number of signals from an array with a larger number of sensors. FIG. 12 shows one approach for accomplishing this with, for example, a set of three signals. In the previous approach in which two sensors were matched, signal B was matched to signal A, and signal A was not modified by the process, i.e. signal A' equals signal A. In other words, signal A is the "reference" signal for the matching process. In the case of more than two sensors, one sensor signal is chosen to be the reference signal, and all others are matched to this reference. In FIG. 12, the signal from Sensor 2 is chosen to be the reference signal, signal A. This might be the middle microphone of a three-microphone linear array of microphones, for example. Therefore, signal A is supplied to the signal matching blocks, 81 and 82 (as A1 and A2), as well as providing the "matched" output signal, A', for Sensor 2. The Sensor 1 signal, B1, is supplied to signal matching block, 81, while the signal from Sensor 3, B2, is supplied to signal matching block, 82. Blocks 81 and 82 operate to match their respective B signals to the reference signal, A, and to produce the matched signals B1' and B2'. Thus, the signal from Sensor 1 is matched to the signal from Sensor 2, and the signal from Sensor 3 is also matched to the signal from Sensor 2. This same means can be expanded to match any number of sensor signals from an array of any size.

It should be appreciated that the teachings herein are applicable to omni-directional as well as inherently directional array elements.

One approach in accordance with certain embodiments is:

a. Design the sensor array system
b. Select pairs of sensors for which signal magnitudes shall be matched
c. Determine the system conditions when the pairs of sensor signals will have equal signal magnitudes
d. Determine the phase difference, β (usually zero), meeting the conditions in c)
e. Define an acceptable tolerance or averaging weight function for each condition based on system requirements
f. Apply the matching approach such as that of FIG. 9 to the pairs of signals
g. Provide the matched output signals to the system's process of choice As an illustrative example of the signal matching described herein, assume that the magnitude of signal A (hereinafter, A) for a particular frequency band is 1.0, while for example, the magnitude of signal B (hereinafter B) is lower, say by 2 dB. This would make the magnitude of B be about 80% that of A. At block 94, the magnitude ratio is calculated and in this case, the output of the block would be $|A|/|B|=1.0/0.8=1.25$. Assuming that when averaged over time in block 95, this is also the average value of the output from block 94, then this is the value which is stored in the matching table at block 96. When applied to B at block 97, the matched output signal B' has a magnitude that is $|B'|=0.8\times1.25=1.0$ which exactly matches the magnitude of A. Since A=A', then the magnitudes of the pair of output signals A' and B' are matched, i.e. both equal 1.0.

There are alternatives to this process. First, the signal magnitudes can be converted to the logarithmic domain prior to the matching process. In this case the division calculation at block 94, which can be compute intensive in the linear domain, becomes a subtraction calculation in the log domain, thus saving computations. Also the multiplication calculation at block 97 becomes an addition calculation further saving calculations. It is also possible to calculate the logarithm after block 94, so that only the block 97 multiplication is done in the log domain. Although this arrangement can actually be more complicated and compute intensive, computational savings may be available in certain applications. Similarly, just the block 94 process can be done in the log domain, but again this may produce computational savings in only a few applications.

Another alternative is to compute, at block 94, the value of $(|A|-|B|)/|B|$ and average this to produce the value stored in the table. When applying the matching at block 97, the equation $|B'|=(1+\text{Table Value})\times|B|$ is used. Although this method introduces two "add" operations for each frame and frequency band, it can reduce the dynamic range required in the averaging operation.

Also the averaging operation at block 95 can be done in the log domain. If a simple average is calculated, but of the logarithmic values of the magnitude ratios from block 94, then the result is the geometric mean of those values in the linear domain. This can be beneficial in many applications. However, the difference between the geometric mean and the linear domain arithmetic mean, or simple average, is slight since the typical mic magnitude differences are slight, e.g. generally a few dB at most.

An additional way for generating a geometric mean match is to calculate the square root of the $|B|\div|A|$ ratio (i.e. $\sqrt{(|B|/|A|)}$ at block 94. After averaging at block 95 and storing in table 96, the retrieved average matching value is applied to signal B as shown in FIG. 9, but an additional operation (not shown) multiplies signal A by the reciprocal of the retrieved value. In this way, both signals' magnitudes are moved toward each other until they are matched to each other at the average geometric mean magnitude.

Another alternative is to compute the phase difference of the post-matched signal pair, A' and B', and use that difference to control the matching process, but this may be a trivial alternative, since the phases of the pre-matched and post matched signals are identical to each other.

Another alternative is to apportion the matching adjustment to both signals, not just apply 100% of it to the signal B as in the discussion above. Other matching proportions can be used as well. For example, the matching adjustment could be applied equally to both signal A and signal B, i.e. on a 50%-50% basis. In this case, using the 2 dB mismatch example above, the magnitude of signal A could be reduced by 1 dB, while the magnitude of signal B could be increased by the same amount to create a matched pair of signals A' and B'. Of course, the apportionment could be in any ratio, e.g. 30%-70% etc.

Another consideration is operation in quiet. When the ambient noise is very low, the matching table values may deviate from the preferred match because of sensor self-noise. If the input signal level falls below the level of the self-noise, the self-noise in signals A and B will dominate and the matching table can be, at least partially, updated on the noise. Of course, beamformers are a class of noise cancellers, so when the ambient noise is very low, it is usually inconsequential if the noise cancellation performance degrades and allows more noise through the system. However, if this effect is a problem, then it can be remedied by adding a block to test each signal magnitude, i.e. |A| and |B| of FIG. 9, to determine if each is above a self-noise threshold. Then at block 94 of this figure, the table updates are disabled whenever both signal magnitudes are below the self-noise. The threshold can be set to any preferred amount above the self-noise to provide a safe buffer zone. As an example, assume a microphone system. Most mics have a self-noise that is equivalent to about 30 dB SPL (Sound Pressure Level). Given the microphone sensitivity, this corresponds to a known mic output signal level, and a threshold can be chosen at or above this signal level to prevent "false" self-noise based updates to the matching table.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted based on the foregoing description. This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. A method for matching sensors comprising:

generating a first sensor signal from a first sensor;

generating a second sensor signal from a second sensor;

separating the first sensor signal into a magnitude component and a phase component;

separating the second sensor signal into a magnitude component and a phase component;

determining if the magnitude component of at least one of the first or second sensor signals is above a self-noise threshold;

determining if a phase difference of the phase components of the phase components is within a specified tolerance of a predetermined phase difference threshold; and if the magnitude component of at least one of the first or second sensor signals is above the self-noise threshold, and the phase difference is within the specified tolerance of the predetermined phase difference threshold, matching the magnitude of the first sensor signal to that of the second sensor signal by multiplying the magnitude of the first sensor signal by a magnitude correction value that is a function of a ratio of the magnitude components of the first and second sensor signals.

2. The method of claim 1, wherein said matching comprises matching the magnitude components of the first and second sensor signals at an average geometric mean and includes multiplying the second signal by a reciprocal of a square root of the ratio of the magnitude components.

3. The method of claim 2, wherein the predetermined phase difference threshold is zero.

4. The method of claim 2, wherein the predetermined phase difference threshold is a function of frequency.

5. The method of claim 1, further comprising updating the magnitude correction value when the phase difference is within the specified tolerance of the predetermined phase difference threshold.

6. The method of claim 5, wherein said updating comprises averaging with a previous magnitude correction value.

7. The method of claim 1, further comprising:

generating a third sensor signal from a third sensor; and matching the magnitude of the third sensor signal to that of the second sensor signal.

8. The method of claim 1, wherein the magnitude correction value is weighted based on the phase difference.

9. A signal matching system comprising:

a first input operable to receive a first sensor signal;

a second input operable to receive a second sensor signal;

a sensor matching circuit operable to:

separate each of the first and second sensor signals in a magnitude component and a phase component;

determining if the magnitude component of at least one of the first or second sensor signals is above a self-noise threshold;

determine if a phase difference of the phase components is within a specified tolerance of a predetermined phase difference threshold; and if the magnitude component of at least one of the first or second sensor signals is above the self-noise threshold, and the phase difference is within the specified tolerance of the predetermined phase difference threshold, match the magnitude of the first sensor signal to that of the second sensor signal by multiplying the magnitude of the first sensor signal by a magnitude correction value that is a function of a ratio of the magnitude components of the first and second sensor signals.

10. The system of claim 9, wherein said matching comprises matching the magnitude components of the first and second sensor signals at an average geometric mean and includes multiplying the second signal by a reciprocal of a square root of the ratio of the magnitude components.

11. The system of claim 10, wherein the predetermined phase difference is zero.

12. The system of claim 10, wherein the predetermined phase difference value is a function of frequency.

13. The system of claim 9, wherein the sensor matching circuit is further operable to update the magnitude correction value when the phase difference is within the specified tolerance of the predetermined phase difference threshold.

14. The system of claim 13, wherein said updating comprises averaging with a previous magnitude correction value.

15. The system of claim 9, further comprising:

a third input operable to receive a third sensor signal, the sensor matching circuit further operable to match the magnitude of the third sensor signal to that of the second sensor signal.

16. The system of claim 9, wherein the magnitude correction value is weighted based on the phase difference.

17. A computer-readable storage medium having stored thereon a computer program for matching sensor signals, the computer program comprising a routine of set instructions for causing the machine to perform the steps of:

generating a first sensor signal from a first sensor;

generating a second sensor signal from a second sensor;

separating the first sensor signal into a magnitude component and a phase component;

separating the second sensor signal into a magnitude component and a phase component;

determining if the magnitude component of at least one of the first or second sensor signals is above a self-noise threshold;

determining if a phase difference of the phase components is within a specified tolerance of a predetermined phase difference threshold; and if the magnitude component of at least one of the first or second sensor signals is above the self-noise threshold, and the phase difference is within the specified tolerance of the predetermined phase difference threshold, matching the magnitude of the first sensor signal to that of the second sensor signal by multiplying the magnitude of the first sensor signal by a magnitude correction value that is a function of a ratio of the magnitude component of the first and second sensor signals.

18. The computer-readable storage medium of claim 17, further comprising updating the magnitude correction value when the phase difference is within the specified tolerance of the predetermined phase difference threshold.

19. The computer-readable storage medium of claim 18, wherein said updating comprises averaging with a previous magnitude correction value.

20. The computer-readable storage medium of claim 17, wherein the magnitude correction value is weighted based on the phase difference.

* * * * *